US006402312B1

(12) United States Patent
Shekalim

(10) Patent No.: US 6,402,312 B1
(45) Date of Patent: Jun. 11, 2002

(54) INK SUPPLY LINE SHOCK ABSORBER

(75) Inventor: Avraham Shekalim, Nesher (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/664,397

(22) Filed: Sep. 18, 2000

(30) Foreign Application Priority Data

Oct. 5, 1999 (IL) ..... 132222

(51) Int. Cl.[7] ..... B41J 2/17
(52) U.S. Cl. ..... 347/94
(58) Field of Search ..... 347/94, 85, 89; 267/64.19, 64.23, 64.27, 179, 64.13, 113; 141/382

(56) References Cited

U.S. PATENT DOCUMENTS 4,347,524 A * 8/1982 Engel et al. ..... 347/94
4,737,801 A * 4/1988 Ichihashi et al. ..... 347/85
5,309,179 A * 5/1994 Agbezuge et al. ..... 347/92
6,097,417 A * 8/2000 Richardson et al. ..... 347/225

FOREIGN PATENT DOCUMENTS

EP 1 097 815 * 5/2001

OTHER PUBLICATIONS

IBM Technical Disclosure Bulletin, vol. 19 No. 4, Sept 76 (NN76091209), pp. 1–3.*

* cited by examiner

*Primary Examiner*—Michael Nghiem
(74) *Attorney, Agent, or Firm*—Mark M. Friedman

(57) ABSTRACT

A hydraulic shock absorber for connection within an ink supply line which is connected so as to supply ink from a stationary ink reservoir to at least one moving inkjet print head. The shock absorber includes a conduit having at least one wall defining an inlet, an outlet and a contained volume. At least part of the wall is readily deformed by variations in a pressure differential across the part of the wall so as to vary the contained volume. The shock absorber also includes a collapse prevention element, deployed within the conduit, which is configured to prevent deformation of the part of the wall in a manner which would obstruct passage through the conduit from the inlet to the outlet.

7 Claims, 3 Drawing Sheets

INK SUPPLY LINE SHOCK ABSORBER

FIELD AND BACKGROUND OF THE INVENTION

The present invention relates to ink supply for printers and, in particular, it concerns a hydraulic shock absorber for absorbing shock waves in an ink supply line caused by motion of a print head.

It is known to employ an arrangement of one or more inkjet print heads in a scanning motion to achieve full print coverage across the width of a substrate. In order to minimize the size and weight of the moving components, it is preferable that ink be supplied to the print head from a stationary ink reservoir. This is typically achieved by use of a flexible tube connecting from the reservoir to the moving print head. The tube must be sufficiently flexible to allow bending to accommodate the range of movement of the print head while being sufficiently resilient to support itself against the slight negative pressure under which ink is provided to conventional inkjet print heads.

While reducing the weight of the moving components, the use of an external ink reservoir and flexible supply tube present certain problems. Specifically, the sudden stopping and starting of the print head at each end of its scanning motion produces shock waves through the ink in the supply tube. These shock waves may interfere with the droplet ejection mechanism by partially emptying ink from the nozzles, or may cause ink leakage from the nozzles.

A further problem associated with flexible ink supply tubes is the variation of internal volume which occurs on flexing of the tube. A given length of tube has a smaller internal volume when bent than when in an unflexed state. As a result, the volume of ink contained within the supply tube varies as the print head passes across the substrate, causing cyclic pressure variations in the ink supply and requiring wasteful reverse flow from the supply tube back to the reservoir.

There is therefore a need for a shock absorber for an ink supply line which will damp shock waves through the ink within an ink supply line associated with an inkjet print head. It would also be highly advantageous to provide a shock absorber which would help to compensate for volume variations within an ink supply tube during motion of an inkjet print head.

SUMMARY OF THE INVENTION

The present invention is a hydraulic shock absorber for connection within an ink supply line for supplying ink from a stationary ink reservoir to at least one moving inkjet print head.

According to the teachings of the present invention there is provided, a hydraulic shock absorber for connection within an ink supply line which is connected so as to supply ink from a stationary ink reservoir to at least one moving inkjet print head, the shock absorber comprising: (a) a conduit having at least one wall defining an inlet, an outlet and a contained volume, at least part of the wall being readily deformed by variations in a pressure differential across the part of the wall so as to vary the contained volume; and (b) a collapse prevention element deployed within the conduit and configured to prevent deformation of the part of the wall in a manner which would obstruct passage through the conduit from the inlet to the outlet.

According to a further feature of the present invention, the part of the wall is implemented as a deformable tube.

According to a further feature of the present invention, the collapse prevention element is implemented as a helical coil at least part of which is deployed within the deformable tube.

According to a further feature of the present invention, the deformable tube, when in an undeformed cylindrical state, has an internal diameter $D_1$, and the helical coil has an external diameter $D_2$, $D_1$ being at least about 10% greater than $D_2$.

According to a further feature of the present invention, the part of the wall is implemented using flexible material having a gas permeability significantly less than that of silicone.

According to a further feature of the present invention, the part of the wall is implemented using material sufficiently flexible such that, in the absence of the collapse prevention element, the conduit would be substantially closed by collapse of the part of the wall when ambient pressure exceeded a pressure within the contained volume by in excess of about 150 mm, and preferably about 30 mm, head of water.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a hydraulic shock absorber for connection within an ink supply line for supplying ink from a stationary ink reservoir to at least one moving inkjet print head.

The principles and operation of shock absorbers according to the present invention may be better understood with reference to the drawings and the accompanying description.

Figure 1:
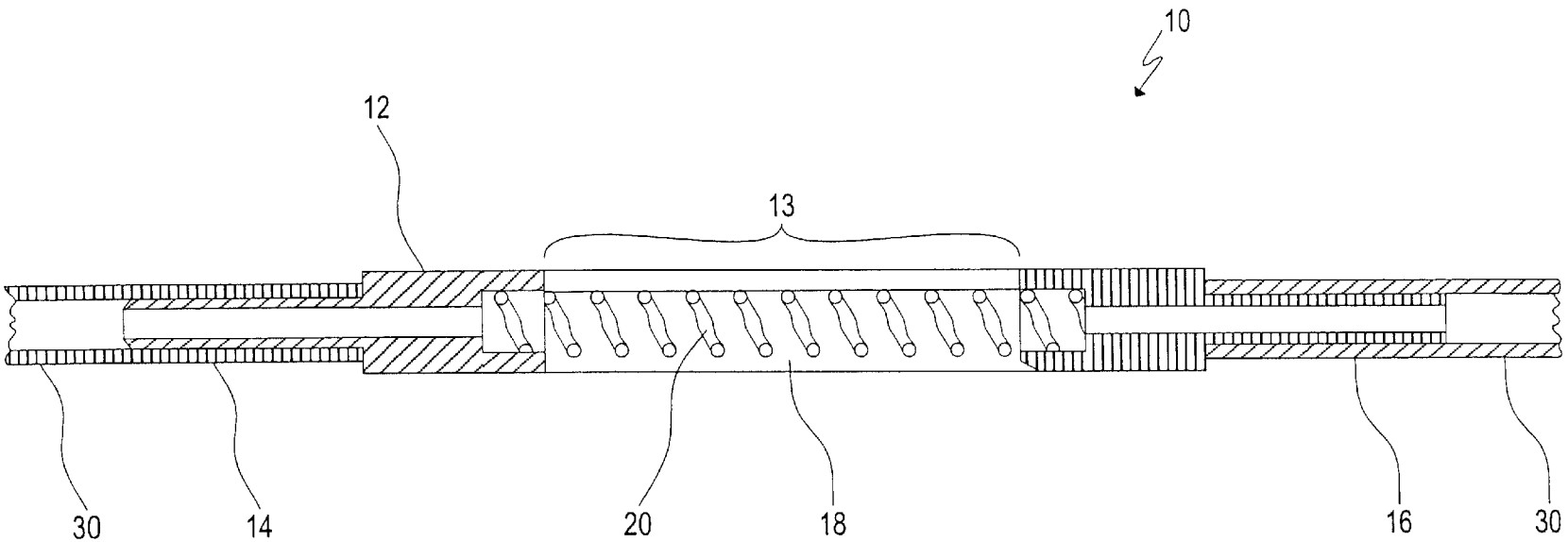
FIG. 1 is a side view of a hydraulic shock absorber, constructed and operative according to the teachings of the present invention.
Figure 2A:
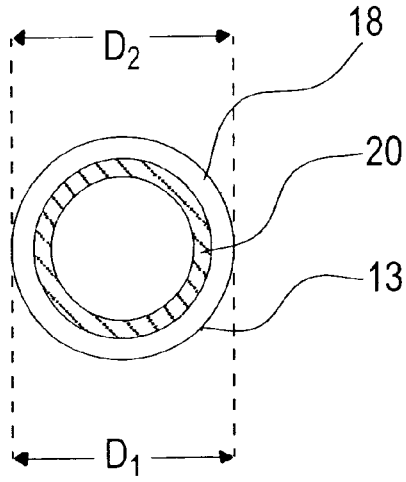
FIGS. 2A–2C are transverse cross-sectional views taken through the hydraulic shock absorber of FIG. 1 under different pressure conditions.
Figure 2B:
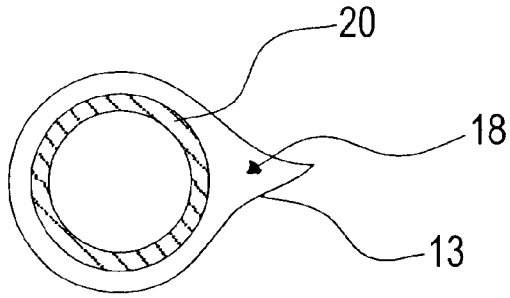
Figure 2C:
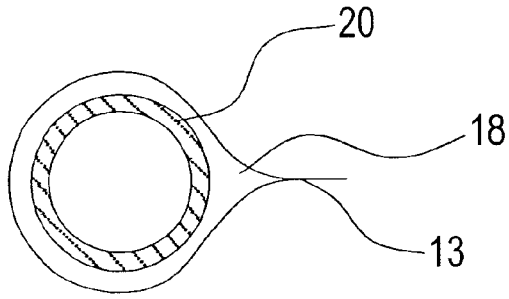
Figure 3:
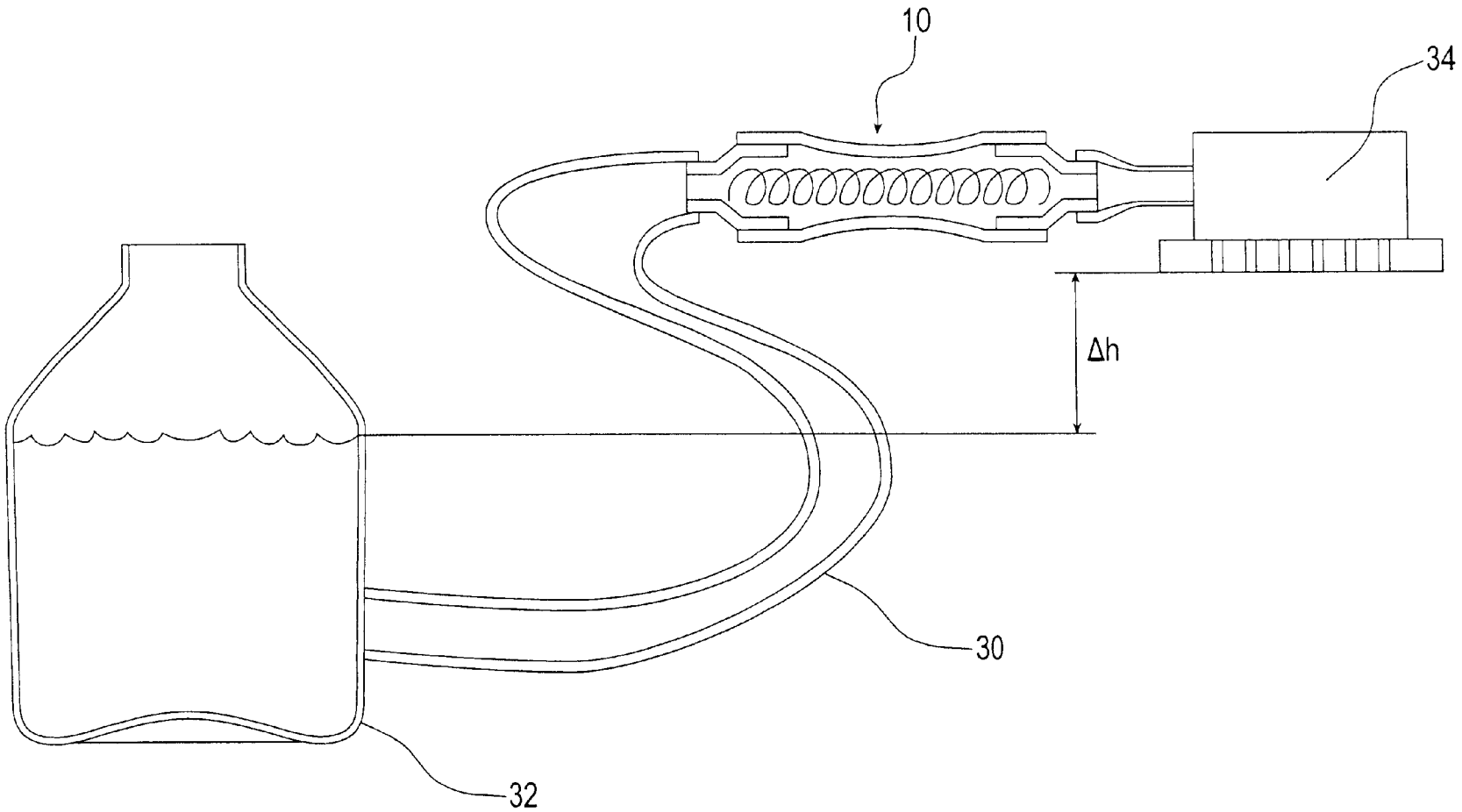
FIG. 3 is a schematic illustration of an inkjet printing system employing the hydraulic shock absorber of FIG. 1.

Referring now to the drawings, FIGS. 1–3 shows a hydraulic shock absorber, generally designated 10, constructed and operative according to the teachings of the present invention. Shock absorber 10 is configured for connection within an ink supply line 30 which is connected so as to supply ink from a stationary ink reservoir 32 to at least one moving inkjet print head 34.

Generally speaking, shock absorber 10 has a conduit formed from one or more wall 12 which defines an inlet 14, an outlet 16 and a contained volume 18. At least part 13 of wall 12 is configured so as to be readily deformed by variations in a pressure differential across wall 12 so as to vary the contained volume 18. Shock absorber 10 also includes a collapse prevention element 20 deployed within the conduit and configured to prevent deformation of deformable part 13 in a manner which would obstruct passage through the conduit from inlet 14 to outlet 16.

It will be readily apparent that shock absorber 10 provides a very simple and cost effective solution to the aforementioned problems of shock waves in the supply line. Specifically, deformable part 13 of wall 12 serves as a damper, dissipating shock waves as momentary volume variations. At the same time, collapse prevention element 20 ensures that the conduit remains open to flow despite the negative pressure differential and any other negative pressure variations which may occur.

Turning now to the features of shock absorber 10 in more detail, FIG. 1 shows the preferred embodiment of shock absorber 10 in which deformable part 13 is implemented as a deformable tube. In order to provide the damping function required, deformable tube 13 must be sufficiently flexible to allow pressure waves to be absorbed as small volumetric changes. Thus, in preferred cases, the deformable wall part is configured such that, in the absence of a collapse prevention element 20, the shock absorber 10 would be substantially closed off by collapse of deformable part 13 whenever the external pressure exceeds the internal pressure by more than about 150 mm head of water. In most preferred cases, such collapse would occur at any pressure differentials in excess of about 30 mm head of water. Since this approaches the reverse pressures commonly present in the ink supply line of inkjet printers, the use of a collapse prevention element 20 becomes imperative.

Because of the relatively low wall thickness of deformable tube 13, use of the materials conventionally employed for ink supply tubes such as silicone could allow significant quantities of atmospheric gases to permeate into the ink flow. To avoid introduction of gases, deformable tube 13 is preferably made from a material selected to provide low gas permeability. Examples of low-permeability flexible materials suitable for deformable tube 13 include, but are not limited to, PVC and Viton™.

In this embodiment, collapse prevention element 20 is implemented as a helical coil 20, at least part of which is deployed within deformable tube 13. Helical coil 20, which is effectively a helical spring, combines excellent resistance to complete collapse of tube 13 with sufficient flexibility to allow bending of deformable tube 13.

It is a further preferred feature of shock absorber 10 that deformable tube 13 remains effective to absorb shock waves even when largely collapsed against coil 20. One preferred implementation of this feature will now be described with reference to FIGS. 2A–2C.

Specifically, referring first to FIG. 2A, deformable tube 13 is preferably somewhat oversized relative to helical coil 20. Thus, if the deformable tube has an internal diameter $D_1$ as measured in an undeformed cylindrical state, and helical coil 20 has an external diameter $D_2$, $D_1$ is preferably at least about 10%, and most preferably at least about 50%, greater than $D_2$. As a result, when the pressure within the tube decreases, deformable tube 13 does not fit snugly to the surface of helical coil 20, instead becoming slightly folded on itself as shown in FIGS. 2B and 2C. In this state, in addition to the fixed volume within coil 20, the internal volume 18 also includes a volume, approximating to a triangular prism, resulting from the inherent resilience of the tube wall material where the two surfaces of the fold try to conform to the shape of the coil. The size of this interstice volume varies as the pressure changes (cf. FIGS. 2B and 2C), thereby maintaining a capability of shock wave absorption even when the deformable tube is mainly collapsed.

Referring finally to FIG. 3, it should be noted that shock absorber 10 is preferably included in supply line 30 in a position proximal to print head(s) 34, and preferably minimally at least within the ¼ of the supply line length closest to the print heads. This allows shock absorber 10 to isolate the print head as much as possible from the inertial effects of ink within the supply line.

It will be appreciated that the above descriptions are intended only to serve as examples, and that many other embodiments are possible within the spirit and the scope of the present invention.

What is claimed is:

1. A fluid supply system including a hydraulic shock absorber for connection within an ink supply line which is connected so as to supply ink from a stationary ink reservoir to at least one moving inkjet print head, the shock absorber comprising:

(a) a conduit having at least one wall defining an inlet, an outlet and a contained volume, at least part of said wall being readily deformed by variations in a pressure differential across said part of said wall so as to vary said contained volume; and (b) a collapse prevention element deployed within said conduit and configured to prevent deformation of said part of said wall in a manner which would obstruct passage through said conduit from said inlet to said outlet, wherein said part of said wall is implemented using material sufficiently flexible such that, in the absence of said collapse prevention element, said conduit would be substantially closed by collapse of said part of said wall when ambient pressure exceeded a pressure within said contained volume by in excess of about 150 mm head of water.

2. The hydraulic shock absorber of claim 1, wherein said part of said wall is implemented as a deformable tube.

3. The hydraulic shock absorber of claim 2, wherein said collapse prevention element is implemented as a helical coil at least part of which is deployed within said deformable tube.

4. The hydraulic shock absorber of claim 3, wherein said deformable tube, when in an undeformed cylindrical state, has an internal diameter $D_1$, and wherein said helical coil has an external diameter $D_2$, $D_1$ being at least about 10% greater than $D_2$.

5. The hydraulic shock absorber of claim 1, wherein said part of said wall is implemented using flexible material having a gas permeability significantly less than that of silicone.

6. The hydraulic shock absorber of claim 1, wherein said part of said wall is implemented using material sufficiently flexible such that, in the absence of said collapse prevention element, said conduit would be substantially closed by collapse of said part of said wall when ambient pressure exceeded a pressure within said contained volume by in excess of about 30 mm head of water.

7. A fluid supply system including a hydraulic shock absorber for connection within an ink supply line which is connected so as to supply ink from a stationary ink reservoir to at least one moving inkjet print head, the shock absorber comprising:

(a) a conduit having at least one wall defining an inlet, an outlet and a contained volume, at least part of said wall being readily deformed by variations in a pressure differential across said part of said wall so as to vary said contained volume; and (b) a collapse prevention element deployed within said conduit and configured to prevent deformation of said part of said wall in a manner which would obstruct passage through said conduit from said inlet to said outlet, wherein said part of said wall is implemented as a deformable tube and wherein said collapse prevention element is implemented as a helical coil at least part of which is deployed within said deformable tube, wherein said deformable tube, when in an undeformed cylindrical state, has an internal diameter D1, and wherein said helical coil has an external diameter D2, D1 being at least about 10% greater than D2.

* * * * *